US006599084B1

(12) United States Patent
Schütz et al.

(10) Patent No.: US 6,599,084 B1
(45) Date of Patent: Jul. 29, 2003

(54) ROTOR FIXTURE FOR A FRICTION VACUUM PUMP

(75) Inventors: Günter Schütz, Köln (DE); Christian Beyer, Köln (DE); Ralf Adamietz, Wermelskirchen (DE); Dieter Haas, Bruchköbel (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/937,876

(22) PCT Filed: Jan. 20, 2000

(86) PCT No.: PCT/EP00/00410

§ 371 (c)(1),
(2), (4) Date: Jan. 9, 2002

(87) PCT Pub. No.: WO00/60241

PCT Pub. Date: Oct. 12, 2000

(30) Foreign Application Priority Data

Apr. 3, 1999 (DE) ..... 199 15 307

(51) Int. Cl.[7] ..... F01D 1/36
(52) U.S. Cl. ..... 415/90; 415/104; 415/216.1
(58) Field of Search ..... 415/104, 134, 415/216.1, 90; 416/244 R, 244 A; 417/365

(56) References Cited

U.S. PATENT DOCUMENTS

| | | | | |
|---|---|---|---|---|
| 2,392,858 A | | 1/1946 | McMahan | 230/134 |
| 2,441,432 A | | 5/1948 | McGee | 230/134 |
| 3,601,501 A | | 8/1971 | Johnson et al. | 416/244 |
| 4,609,332 A | * | 9/1986 | Miki et al. | 417/352 |
| 4,806,074 A | * | 2/1989 | Burger et al. | 415/72 |
| 4,929,151 A | | 5/1990 | Long et al. | 415/177 |
| 5,059,092 A | | 10/1991 | Kabelitz et al. | 415/90 |
| 5,154,572 A | * | 10/1992 | Toyoshima et al. | 415/90 |
| 5,219,269 A | * | 6/1993 | Ikegami et al. | 415/55.1 |

FOREIGN PATENT DOCUMENTS

| | | |
|---|---|---|
| DE | 3919529 C2 | 9/1994 |
| DE | 4445297 | 3/1996 |
| DE | 29717079 U1 | 12/1997 |
| EP | 0 352 688 | 1/1990 |
| EP | 0 414 127 | 2/1991 |

* cited by examiner

*Primary Examiner*—Ninh H. Nguyen
(74) *Attorney, Agent, or Firm*—Fay, Sharpe, Fagan, Minnich & McKee, LLP

(57) ABSTRACT

A friction pump (1), such as turbomolecular pump, includes a steel housing (2) in which a steel shaft (15) is supported by a bearing (16). A rotor (4) with a central bore (21) is mounted on the shaft. In order to reduce the risk of the joint area between the rotor and the shaft becoming loose, a ring groove (26, 31) which encompasses the joint area between the rotor is provided in an area adjacent at least one of the faces of the rotor. A reinforcing ring (34, 35, 38) of a high strength, low thermal expansion material encompasses one of a thrust member (28) and cylindrical rotor sections (32, 37) adjacent the shaft.

13 Claims, 2 Drawing Sheets

ROTOR FIXTURE FOR A FRICTION VACUUM PUMP

BACKGROUND OF THE INVENTION

The present invention relates to a friction vacuum pump, comprising a housing, with a shaft which is supported in the housing by bearings and with a rotor which has a central borehole and which is mounted onto the shaft in the area of said borehole.

Friction vacuum pumps, turbomolecular pumps in particular, are operated at very high speeds (up to 100,000 revolutions per minute). Such operation requires extremely precise balancing of the rotor unit consisting of shaft and rotor. In spite of involved balancing procedures, even so, vibrations (vibration accelerations) were observed ever so often which occurred after a few or after many operating hours and the cause of which was initially unclear.

The inventors have set themselves the target of reducing these interfering vibration effects. Through the measures detailed in the patent claims they have attained this target.

The solutions stated are based on the realisation that the joint area between rotor and shaft is frequently a source of displacements and thus the vibration effects observed. In this area, loosening may occur during the operation of a friction vacuum pump of the kind affected here, for two reasons. One of the reasons is that the occurring centrifugal forces also have an effect on the joint area. A further cause for loosening in the joint area is based on the fact that the rotor material is commonly aluminium and that for the shaft is steel (with a smaller coefficient of expansion compared to aluminium). In the case of increases in temperature, the shaft is not capable of following the temperature induced movements of the rotor. In both instances slots—be they even very minute—are created between shaft and rotor thus causing imbalances. Commonly the phenomena detailed superimpose. Through a tighter fit the effects detailed might be diminished. The selection of a sufficiently tight fits is, however, not possible since the fit between rotor and shaft must, in the radial direction, not be so tight rendering assembly impossible, resp. the required axial forces for bracing the unit are consumed by way of friction.

SUMMARY OF THE INVENTION

Through the measures proposed through the patent claims, the disadvantageous effects detailed are eliminated. Deformations affecting the rotor in the area of the shaft—be they caused by the effect of centrifugal forces or owing to temperature induced movements—can be substantially avoided. As a result this will generally significantly reduce the vibration effects observed, frequently to an extent that these are entirely removed.

Through a ring groove at least in the area of one of the two front faces of the rotor, the effect is attained that the occurring centrifugal forces which attain high values in the area of the rotor's periphery will be ineffectual at least in the area of that rotor section which forms the border of the ring groove according to the present invention towards the inside. At least deformations resulting in loosening within the joint area are substantially prevented in this area. If this area is in addition equipped with a reinforcing ring, then the risk of loosening in the joint area for thermal reasons is also eliminated. Preferably the material the reinforcing ring is made of has a relatively small thermal coefficient of expansion.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
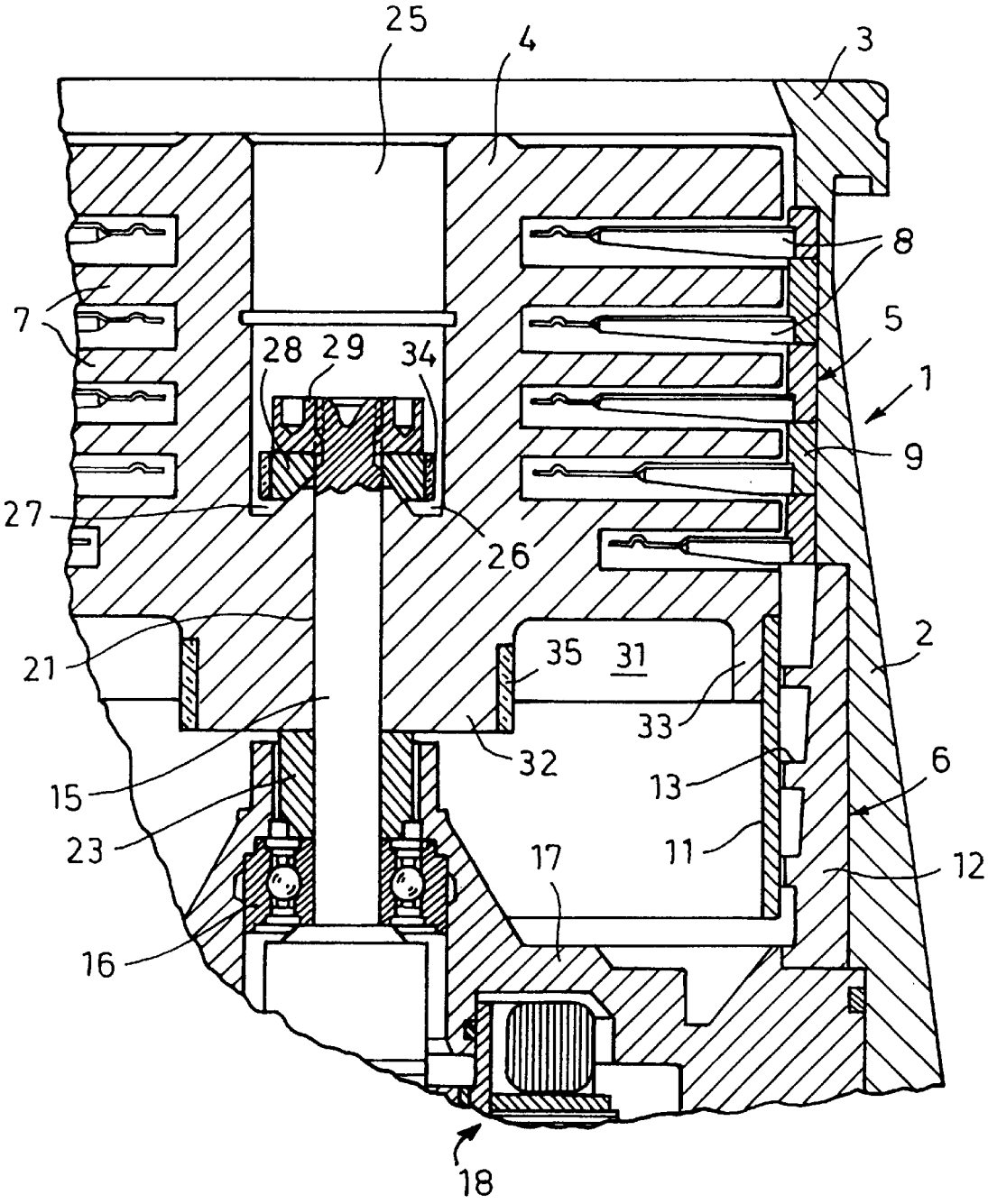
FIG. 1 is a partial sectional view of a single-flow turbomolecular pump in accordance with the present invention.

Depicted in the drawing figures is a partial section through a single-flow turbomolecular vacuum pump 1 comprising a housing 2, with an inlet flange 3 on the front face, a rotor 4 and a stator 5, 6; in the case of the design examples depicted, a compound turbomolecular pump is presented in each case. On the inlet side, the active pumping elements consist of intermeshing rotor blades 7 and stator blades 8. Stator rings 9 forming the stator section 5 on the side of the inlet serve the purpose of holding and centering the stator blades 8. On the fore-vacuum side, a Holweck pumping section is provided formed by a rotating cylinder section 11 and a fixed cylinder section 12 with a thread 13. Cylinder section 12 forms the rotor section 6 on the stator side.

The rotor 4 is mounted on to a shaft 15. The shaft 15 is supported via bearings 16 (only one being depicted) within bearing housing 17, in which the drive motor 18 is also located. For the purpose of mounting the rotor 4 on the shaft 15, the rotor is equipped with a central borehole 21 into which the vacant end of the shaft 15 projects. On the fore-vacuum side the rotor 4 is supported by a sleeve 23, which in turn is supported by the inner ring of the bearing 16. On the high-vacuum side the rotor 4 is equipped with a central recess 25 into which the vacant end of shaft 15 projects. In the area of the recess, the rotor 4 is equipped with a conical section 27 which encompasses the shaft 15 and is designed in such a manner that the conical section tapers off in the direction of the high-vacuum side. Placed on to the conical section is a thrust transmitting member 28, the inside of which is also of conical design, and specifically in such a manner that it is substantially in full surface contact with the conical section 27 of the rotor 4. A nut 29 screwed on to the vacant end of the shaft 15 serves the purpose of affixing the rotor 4 to the shaft 15, said nut pressing the thrust transmitting member 28 on to the conical section of the rotor 4.

One of the measures of avoiding loosening of the joint area between rotor 4 and shaft 15 at high speeds, is a groove 31 embedded in the front face of the rotor 4, said groove being bordered by an inner rotor section 32 and an outer rotor section 33. In the design example depicted, the outer rotor section serves as the carrier for the cylindrical section 11 of the Holweck pump. Also the central recess 25 in the front face of rotor 4 on the high-vacuum side has, in its bottom area, the shape of a ring groove 26 where the inner rotor section is designed to be conical and where the outer rotor section carries the rotor blades 7.

The detailed ring grooves in the front face of the rotor 4 have the effect of relieving the joint area between rotor 4 and shaft 15 at least in the area of the inner rotor sections 27, 32 from the centrifugal forces, i.e. so that the occurring centrifugal forces can not cause the formation of slots and thus any loosening.

Moreover, it is expedient to assign to the inner rotor sections 27, 32 reinforcing rings 34, 35 made of a high-strength material and small thermal expansion, in particular in those cases where the shaft 15 is made of steel and the rotor 4 is made of aluminium. Thus the formation of slots in the joint area can be avoided, which can not only be caused by the occurring centrifugal forces but also owing to the different a thermal coefficients of expansion for steel and aluminium. As the material for the reinforcing rings the use of carbon fibre composite (carbon or glass fibre compound materials) is an expedient possibility.

The thrust transmitting member 28 is preferably made of steel. The formation of slots between the shaft 15 and the rotor section 27 is thus also avoided.

Figure 2:
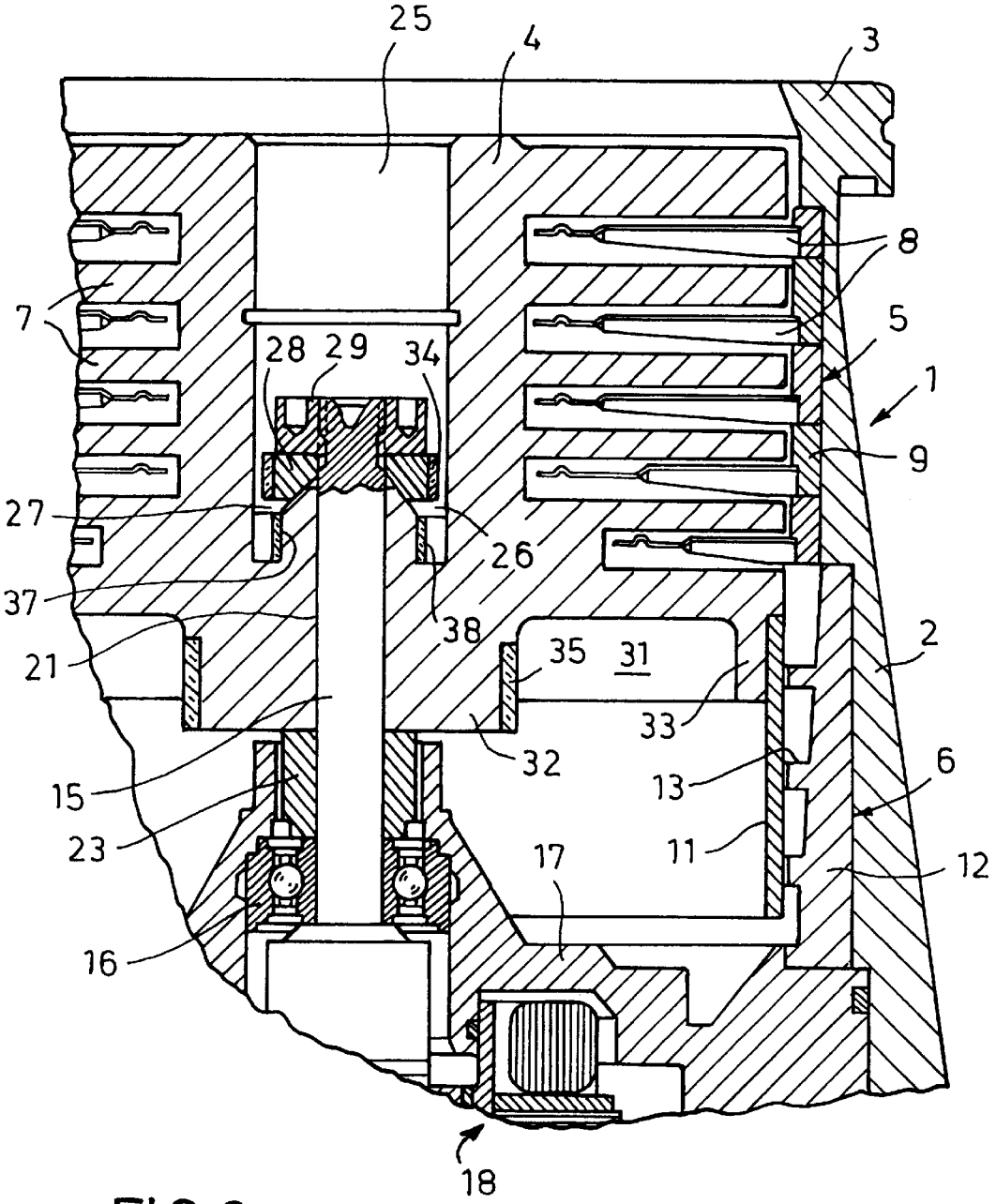
FIG. 2 is a partial sectional view of an alternate embodiment of a single-flow turbomolecular pump in accordance with the present invention.

In the design example according to drawing FIG. 2 the inner section of the ring groove 26 not only encompasses the conical section 27 but also a cylindrical section 37. Also this section is equipped with a reinforcing ring 38 in order to ensure a joint area free of slots between shaft 15 and rotor 4.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A friction pump comprising:

a housing;

a shaft which is supported in the housing by bearings;

a rotor which has a central borehole and which is mounted onto the shaft in an area of said borehole; and, a ring groove that encompasses a joint area between the rotor and the shaft provided in an area of at least one of front and rear faces of said rotor, the ring groove being limited by an inner and an outer rotor section, the inner rotor section, including a reinforcing ring made of a high strength material with small thermal expansion.

2. The friction pump according to claim 1, wherein the reinforcing ring encompasses a cylindrically shaped rotor section.

3. The friction pump according to claim 1, wherein the reinforcing ring encompasses a thrust transmitting member encompassing a rotor section.

4. The friction pump according to claim 3, wherein contact surfaces of the thrust transmitting member and the related rotor section are conical.

5. The friction pump according to claim 4, wherein the cone shaped rotor section is located within a recess on a high-vacuum side and forms a ring groove with the outer rotor section.

6. The friction pump according to claim 5, wherein the shaft projects into the recess and is equipped with a thread, and where a nut presses the thrust transmitting member on to the rotor section.

7. The friction pump according to claim 6, wherein the rotor is made of aluminum, the shaft, thrust transmitting member, and nut are made of steel, and the reinforcing rings are made of carbon fiber composite.

8. The friction pump according to claim 5, wherein the inner rotor section of the ring groove also encompasses the conical section for the thrust transmitting member and a further cylindrical section.

9. The friction pump according to claim 8, wherein each reinforcing ring is assigned to both the thrust transmitting member and the cylindrical section.

10. A turbomolecular vacuum pump comprising:

a stator supported in a housing;

a shaft rotatably mounted to the housing and disposed within the stator;

a rotor rotatably received in the stator, the rotor including:

a central well in a high vacuum face of the rotor, a projecting portion extending from an inner end of the central well, the projecting portion having a conical surface at an outer end thereof, a bore extending from a low vacuum face of the rotor, through the rotor and centrally through the projecting portion;

a thrust ring received on the shaft and having a conical inner surface that is received on the projecting portion conical surface, an innermost face of the thrust ring being displaced from the inner end of the central well.

11. The turbomolecular vacuum pump according to claim 10 further including:

a reinforcing ring made of a high strength material which has a lower thermal expansion than the rotor, the reinforcing ring encircling and compressing one of:

the thrust ring, the projecting portion in the central well below the thrust ring, and a cylindrically-shaped rotor section which surrounds the shaft at the low vacuum face of the rotor.

12. The turbomolecular pump according to claim 11 wherein:

the rotor is made of aluminum; and, the reinforcing ring is made of one of steel and carbon fiber composite.

13. A friction pump comprising:

a housing;

a shaft supported in the housing by bearings;

a rotor having an inner rotor section and an outer rotor section, a central bore hole being defined through the inner rotor section, the shaft extending into the bore hole and being connected with the inner rotor section, the rotor having a ring groove defined in at least one of front and rear faces of the rotor, the ring groove being limited by the inner and outer rotor sections;

a reinforcing ring disposed in the ring groove surrounding a portion of the inner rotor section between the central bore hole and the ring groove to reinforce the portion of the inner rotor sections.

* * * * *